US010294541B2

(12) United States Patent
Park et al.

(10) Patent No.: US 10,294,541 B2
(45) Date of Patent: May 21, 2019

(54) QUENCHED STEEL SHEET HAVING EXCELLENT STRENGTH AND DUCTILITY

(71) Applicant: POSCO, Pohang-si, Gyeongsangbuk-do (KR)

(72) Inventors: Kyong-Su Park, Pohang-si (KR); Jae-Hoon Jang, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 260 days.

(21) Appl. No.: 15/101,384

(22) PCT Filed: Dec. 24, 2013

(86) PCT No.: PCT/KR2013/012132
§ 371 (c)(1),
(2) Date: Jun. 2, 2016

(87) PCT Pub. No.: WO2015/099214
PCT Pub. Date: Jul. 2, 2015

(65) Prior Publication Data

US 2016/0348207 A1 Dec. 1, 2016

(30) Foreign Application Priority Data

Dec. 23, 2013 (KR) ..... 10-2013-0161430

(51) Int. Cl.
*C22C 38/02* (2006.01)
*C22C 38/04* (2006.01)
(Continued)

(52) U.S. Cl.
CPC ..... *C21D 9/46* (2013.01); *C21D 1/18* (2013.01); *C21D 8/02* (2013.01); *C21D 8/021* (2013.01);
(Continued)

(58) Field of Classification Search
None
See application file for complete search history.

(56) References Cited

U.S. PATENT DOCUMENTS 8,480,824 B2 7/2013 Cola, Jr. et al.
2004/0238081 A1 12/2004 Yoshinaga et al.
(Continued)

FOREIGN PATENT DOCUMENTS

CN 1547620 A 11/2004
CN 1692166 A 11/2005
(Continued)

OTHER PUBLICATIONS

Machine-English translation of JP 2013-076155 A, Sugimot Koichi et al., Apr. 25, 2013.*
(Continued)

*Primary Examiner* — Deborah Yee
(74) *Attorney, Agent, or Firm* — Morgan Lewis & Bockius LLP

(57) ABSTRACT

Disclosed are a quenched steel sheet and a method for manufacturing the same. The quenched steel sheet according to an aspect of the present invention contains, in terms of wt %, C: 0.05~0.25%, Si: 0.5% or less (excluding 0), Mn: 0.1~2.0%, P: 0.05% or less, S: 0.03% or less, the remainder Fe, and other unavoidable impurities, wherein a refined structure of the steel sheet comprises 90 volume % or more of martensite with a first hardness and martensite with a second hardness.

4 Claims, 3 Drawing Sheets

(51) Int. Cl.

| | |
|---|---|
| ***C21D 9/46*** | (2006.01) |
| ***C21D 8/02*** | (2006.01) |
| ***C22C 38/00*** | (2006.01) |
| ***C21D 8/04*** | (2006.01) |
| ***C21D 1/18*** | (2006.01) |

(52) U.S. Cl.

CPC ..... *C21D 8/0236* (2013.01); *C21D 8/0436* (2013.01); *C21D 8/0447* (2013.01); *C21D 8/0473* (2013.01); *C22C 38/00* (2013.01); *C22C 38/002* (2013.01); *C22C 38/02* (2013.01); *C22C 38/04* (2013.01); *C21D 2201/00* (2013.01); *C21D 2211/001* (2013.01); *C21D 2211/005* (2013.01); *C21D 2211/008* (2013.01); *C21D 2211/009* (2013.01)

(56) References Cited

U.S. PATENT DOCUMENTS

| | | | |
|---|---|---|---|
| 2007/0261770 | A1 | 11/2007 | Cola et al. |
| 2009/0252641 | A1 | 10/2009 | Hoshi et al. |
| 2010/0051146 | A1 | 3/2010 | Park et al. |
| 2010/0132854 | A1 | 6/2010 | Cola, Jr. |
| 2010/0163140 | A1 | 7/2010 | Cola, Jr. |
| 2012/0042994 | A1 | 2/2012 | Fujita et al. |
| 2012/0175028 | A1 | 7/2012 | Matsuda et al. |
| 2013/0048151 | A1 | 2/2013 | Kawamura et al. |
| 2015/0050519 | A1 | 2/2015 | Nonaka et al. |

FOREIGN PATENT DOCUMENTS

| | | | |
|---|---|---|---|
| EP | 1486574 | A1 | 12/2004 |
| EP | 2581465 | A1 | 4/2013 |
| JP | 3-087320 | A | 4/1991 |
| JP | 2006-70328 | A | 3/2006 |
| JP | 2008-255469 | A | 10/2008 |
| JP | 2010-065272 | A | 3/2010 |
| JP | 2010-174280 | A | 8/2010 |
| JP | 2010-196106 | A | 9/2010 |
| JP | 2011-47034 | A | 3/2011 |
| JP | 2011-52295 | A | 3/2011 |
| JP | 2011-179030 | A | 9/2011 |
| JP | 2011-202207 | A | 10/2011 |
| JP | 2013-76155 | A | 4/2013 |
| KR | 0270395 | B1 | 8/2000 |
| KR | 10-0716342 | B1 | 5/2007 |
| KR | 2007-0086335 | A | 8/2007 |
| KR | 10-2007-0099693 | A | 10/2007 |
| KR | 0782785 | B1 | 11/2007 |
| KR | 10-1054773 | B1 | 8/2011 |
| KR | 10-2013-0016433 | A | 2/2013 |
| KR | 10-2013-0096213 | A | 8/2013 |
| WO | 2013/105631 | A1 | 7/2013 |

OTHER PUBLICATIONS

International Search Report dated Sep. 29, 2014 issued in International Patent Application No. PCT/KR2013/012132 (English translation).

Chinese Office Action dated Feb. 20, 2017 issued in Chinese Patent Application No. 201380081843.2 (with English translation).

Japanese Office Action dated Aug. 22, 2017 issued in Japanese Patent Application No. 2016-542201.

Extended European Search Report dated Nov. 23, 2016 issued in European Patent Application No. 13900181.2.

* cited by examiner

【Figure 1】
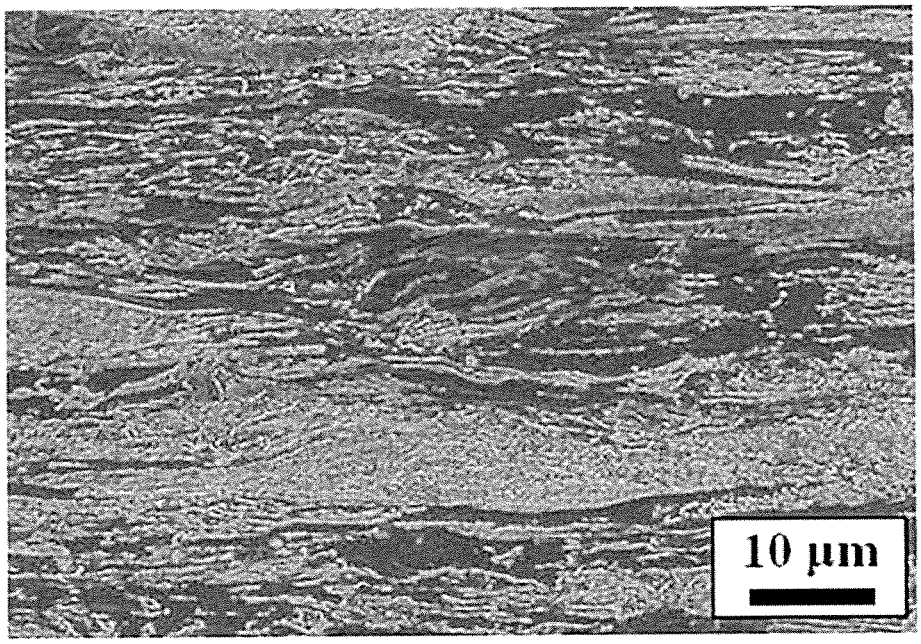

【Figure 2】
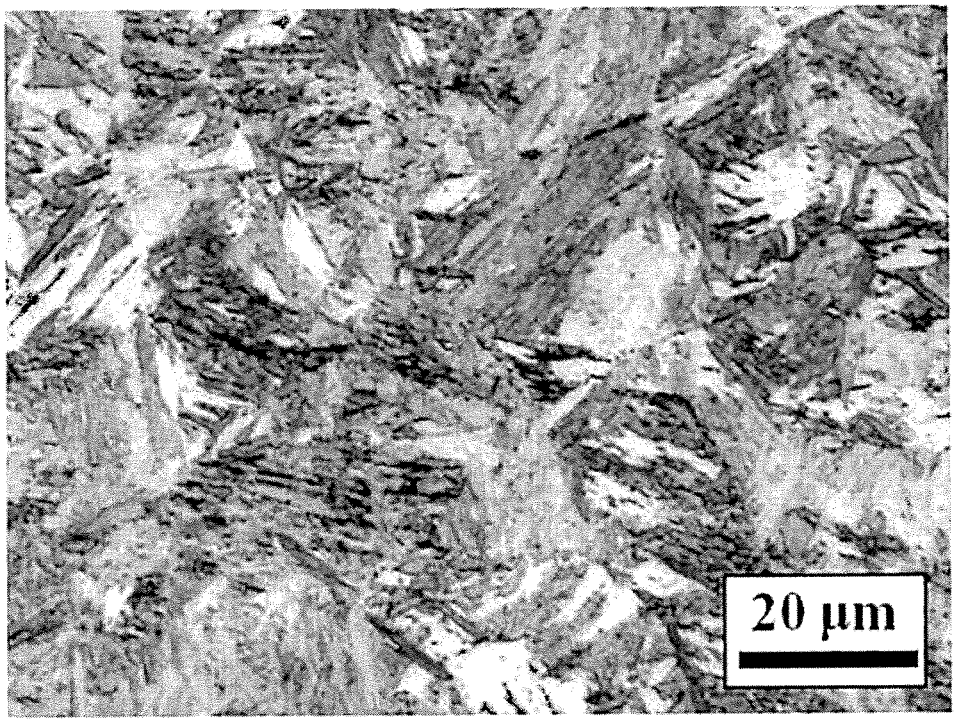

【Figure 3】
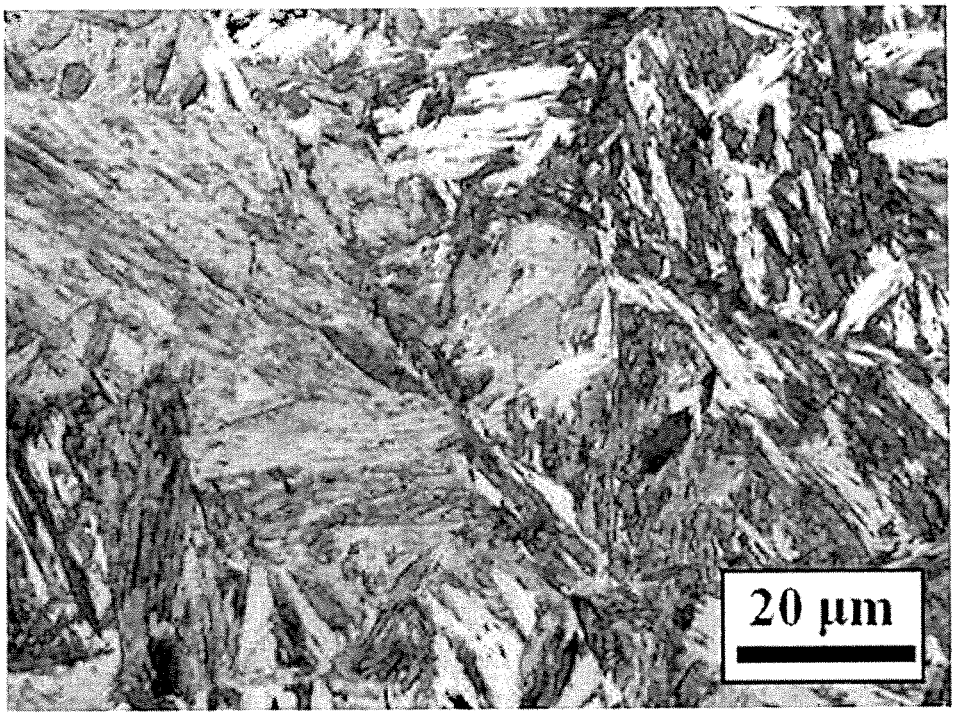

QUENCHED STEEL SHEET HAVING EXCELLENT STRENGTH AND DUCTILITY

RELATED APPLICATIONS

This application is the U.S. National Phase under 35 U.S.C. § 371 of International Application No. PCT/KR2013/012132, filed on Dec. 24, 2013, which in turn claims the benefit of Korean Patent Application No. 10-2013-0161430 filed on Dec. 23, 2013, the disclosure of which applications are incorporated by reference herein.

TECHNICAL FIELD

The present disclosure relates to a quenched steel plate having excellent strength and ductility and a method of manufacturing the same.

BACKGROUND ART

In terms of steel, strength and ductility are inversely related, and the following technologies according to the related art are used as methods of obtaining steel having excellent strength and ductility.

As representative examples, there are technologies of controlling a phase fraction of a ferrite, bainite, or martensite structure such as dual phase (DP) steel disclosed in Korean Patent Publication No. 0782785, transformation induced plasticity (TRIP) steel disclosed in Korean Patent Publication No. 0270396, as well as controlling a residual austenite fraction by utilizing an alloying element such as manganese (Mn), nickel (Ni), or the like disclosed in Korean Patent Publication No. 1054773.

However, in a case of DP steel or TRIP steel, increases in strength are limited to 1200 MPa. In addition, in the case of a technology of controlling a residual austenite fraction, increases in strength are limited to 1200 MPa, and there may be a problem of increased manufacturing costs due to the addition of a relatively expensive alloying element.

Thus, the development of a steel in which relatively expensive alloying elements may be used in significantly reduced amounts and excellent strength and ductility may be provided is required.

DISCLOSURE

Technical Problem

An aspect of the present disclosure may provide a quenched steel sheet having excellent strength and ductility without adding a relatively expensive alloying element by properly controlling an alloy composition and heat treatment conditions, and a method of manufacturing the same.

Technical Solution

According to an aspect of the present disclosure, a quenched steel sheet may be a steel plate including, by wt %, carbon (C): 0.05% to 0.25%, silicon (Si): 0.5% or less (with the exception of 0), manganese (Mn): 0.1% to 2.0%, phosphorus (P): 0.05% or less, sulfur (S): 0.03% or less, iron (Fe) as a residual component thereof, and other unavoidable impurities. The quenched steel sheet may include 90 volume % or more of martensite having a first hardness and martensite having a second hardness as a microstructure of the steel plate. The first hardness may have a greater hardness value than a hardness value of the second hardness, and a ratio of a difference between the first hardness and the second hardness and the first hardness may satisfy relational expression 1.

$$5 \leq (\text{first hardness-second hardness})/(\text{first hardness}) * 100 \leq 30 \quad \text{[Relational Expression 1]}$$

According to another aspect of the present disclosure, a quenched steel sheet may be a quenched steel sheet provided by cold rolling and heat treating a steel plate including, by wt %, carbon (C): 0.05% to 0.25%, silicon (Si): 0.5% or less (with the exception of 0), manganese (Mn): 0.1% to 2.0%, phosphorus (P): 0.05% or less, sulfur (S): 0.03% or less, iron (Fe) as a residual component thereof, and other unavoidable impurities, and including ferrite and pearlite as a microstructure. The microstructure of the quenched steel sheet includes 90 volume % or more of martensite having a first hardness and martensite having a second hardness. The martensite having the first hardness is provided through transformation occurring from pearlite before heat treatment and in a region adjacent to the pearlite before heat treatment, and the martensite having the second hardness is provided through transformation occurring from ferrite before heat treatment and in a region adjacent to the ferrite before heat treatment.

According to another aspect of the present disclosure, a method of manufacturing a quenched steel sheet according to an exemplary embodiment in the present disclosure may include: cold rolling a steel plate including, by wt %, carbon (C): 0.05% to 0.25%, silicon (Si): 0.5% or less (with the exception of 0), manganese (Mn): 0.1% to 2.0%, phosphorus (P): 0.05% or less, sulfur (S): 0.03% or less, iron (Fe) as a residual component thereof, and other unavoidable impurities, and including ferrite and pearlite as a microstructure at a reduction ratio of 30% or more; heating the cold-rolled steel plate to a heating temperature (T*) of Ar3° C. to Ar3+500° C.; and cooling the heated steel plate. A heating rate ($v_r$, ° C./sec) satisfies relational expression 2 when heating the steel plate, and a cooling rate ($v_c$, ° C./sec) satisfies relational expression 3 when cooling the steel plate.

$$v_r \geq (T^*/110)^2 \quad \text{[Relational Expression 2]}$$

$$v_c \geq (T^*/80)^2 \quad \text{[Relational Expression 3]}$$

Advantageous Effects

According to an exemplary embodiment in the present disclosure, a quenched steel sheet having excellent strength and ductility, of which a tensile strength is 1200 MPa or more and elongation is 7% or more without adding a relatively expensive alloying element, may be provided.

DESCRIPTION OF DRAWINGS

FIG. 1 illustrates a microstructure of a steel plate before heat treatment, observed with an electron microscope, according to an exemplary embodiment in the present disclosure.

FIG. 2 illustrates a microstructure, observed with an optical microscope, of a steel plate after heat treatment of inventive example 4 meeting conditions of an exemplary embodiment in the present disclosure.

FIG. 3 illustrates a microstructure, observed with an optical microscope, of a steel plate after heat treatment of comparative example 5 under conditions other than those of an exemplary embodiment in the present disclosure.

BEST MODE FOR INVENTION

The inventors have conducted research to solve problems of the above described related art. As a result, a carbon content may be properly provided and cold rolling and a heat treatment process may be properly controlled in the present disclosure, thereby forming two kinds of martensite having different levels of hardness as a microstructure of a steel plate. Thus, a steel plate capable of having improved strength and ductility without adding a relatively expensive alloying element may be provided.

Hereafter, a quenched steel sheet having excellent strength and ductility according to an exemplary embodiment in the present disclosure will be described in detail. In the present disclosure, 'heat treatment' means heating and cooling operations carried out after cold rolling.

First, an alloy composition of a quenched steel sheet according to an exemplary embodiment in the present disclosure is described in detail.

Carbon (C): 0.05 wt % to 0.25 wt %

Carbon is an essential element for improving the strength of a steel plate, and carbon may be required to be added in a proper amount to secure martensite which is required to be implemented in the present disclosure. In a case in which the content of C is less than 0.05 wt %, it may be difficult not only to obtain sufficient strength of a steel plate, but also to secure a martensite structure of 90 volume % or more as a microstructure of a steel plate after heat treatment. On the other hand, in a case in which the content of C exceeds 0.25 wt %, ductility of the steel plate may be decreased. In the present disclosure, the content of C may be properly controlled within a range of 0.05 wt % to 0.25 wt %.

Silicon (Si): 0.5 wt % (with the Exception of 0)

Si may serve as a deoxidizer, and may serve to improve strength of a steel plate. In a case in which the content of Si exceeds 0.5 wt %, scale may be formed on a surface of the steel plate in a case in which the steel plate is hot-rolled, thereby degrading surface quality of the steel plate. In the present disclosure, the content of Si may be properly controlled to be 0.5 wt % or less (with the exception of 0).

Manganese (Mn): 0.1 wt % to 2.0 wt %

Mn may improve strength and hardenability of steel, and Mn may be combined with S, inevitably contained therein during a steel manufacturing process to then form MnS, thereby serving to suppress the occurrence of crack caused by S. In order to obtain the effect in the present disclosure, the content of Mn may be 0.1 wt % or more. On the other hand, in a case in which the content of Mn exceeds 2.0 wt %, toughness of steel may be decreased. In the present disclosure, thus, the content of Mn may be controlled to be within a range of 0.1 wt % to 2.0 wt %.

Phosphorus (P): 0.05 wt % or Less

P is an impurity inevitably contained in steel, and P is an element that is a main cause of decreasing ductility of steel as P is organized in a grain boundary. Thus, a content of P may be properly controlled to be as relatively low. Theoretically, the content of P may be advantageously limited to be 0%, but P is inevitably provided during a manufacturing process. Thus, it may be important to manage an upper limit thereof. In the present disclosure, an upper limit of the content of P may be managed to be 0.05 wt %.

Sulfur (S): 0.03 wt % or Less

S is an impurity inevitably contained in steel, and S is an element to be a main cause of increasing an amount of a precipitate due to MnS formed as S reacts to Mn, and of embrittling steel. Thus, a content of S may be controlled to be relatively low. Theoretically, the content of S may be advantageously limited to be 0%, but S is inevitably provided during a manufacturing process. Thus, it may be important to manage an upper limit. In the present disclosure, an upper limit of the content of S may be managed to be 0.03 wt %.

The quenched steel sheet may also include iron (Fe) as a remainder thereof, and unavoidable impurities. On the other hand, the addition of an active component other than the above components is not excluded.

Hereinafter, a microstructure of a quenched steel sheet according to an exemplary embodiment in the present disclosure will be described in detail.

A quenched steel sheet according to an exemplary embodiment in the present disclosure may satisfy a component system, and may include 90 volume % or more of martensite having a first hardness and martensite having a second hardness as a microstructure of a steel plate. In a case in which two kinds of martensite are less than 90 volume %, it may be difficult to sufficiently secure required strength. Meanwhile, according to an exemplary embodiment in the present disclosure, the remainder of microstructures, other than the martensite structure, may include ferrite, pearlite, cementite, and bainite.

According to an exemplary embodiment in the present disclosure, the quenched steel sheet is a steel plate manufactured by cold rolling and heat treating a steel plate including ferrite and pearlite as a microstructure. The martensite having the first hardness may be obtained by being transformed from pearlite before heat treatment and in a region adjacent thereto, and the martensite having the second hardness may be obtained by being transformed from ferrite before heat treatment and in a region adjacent thereto. As described later in the present disclosure, in a case in which heat treatment conditions of a cold-rolled steel plate are properly controlled, the diffusion of carbon may be significantly reduced, thereby forming two kinds of martensite as described above.

In a case in which such a structure is secured as the microstructure of the steel plate, first transformation may occur in martensite having relatively low hardness in an initial process. As subsequent transformation proceeds, work hardening may occur, thereby improving ductility of the steel plate. In order to obtain the above effect according to an exemplary embodiment in the present disclosure, a ratio of a difference between the first hardness and the second hardness and the first hardness may be properly controlled to satisfy relational expression 1. In a case in which the ratio thereof is less than 5%, an effect of improving ductility of the steel plate may be insufficient, while in a case in which the ratio thereof exceeds 30%, transformation may be concentrated on an interface of structures of two kinds of martensite, whereby a crack may occur. Thus, ductility of the steel plate may be decreased.

$$5 \leq (\text{first hardness-second hardness})/(\text{first hardness}) * 100 \leq 30 \quad \text{[Relational Expression 1]}$$

Meanwhile, according to an exemplary embodiment in the present disclosure, an average packet size of the two kinds of martensite may be 20 μm or less. In a case in which the packet size exceeds 20 μm, since a block size and a plate size inside a martensite structure are increased simultaneously, strength and ductility of the steel plate may be decreased. Thus, the packet size of the two kinds of martensite may be properly controlled to be 20 μm or less.

Hereafter, according to another exemplary embodiment in the present disclosure, a method of manufacturing a quenched steel sheet having excellent strength and ductility will be described in detail.

The steel plate satisfying the afore-described composition and including ferrite and pearlite as a microstructure may be cold-rolled. As described above, ferrite and pearlite are sufficiently secured as a microstructure of a steel plate before heat treatment. In a case in which heat treatment conditions are properly controlled, two kinds of martensite having different levels of hardness after heat treatment may be formed.

In a case in which the steel plate is cold rolled, a reduction ratio thereof may be 30% or more. As described above, in a case in which the steel plate is cold-rolled at a reduction ratio of 30% or more, as a ferrite structure is elongated in a rolling direction, a relatively large amount of residual transformation may be included inside thereof. In addition, as a pearlite structure is also elongated in a rolling direction, a fine carbide may be formed therein. The cold-rolled ferrite and pearlite structures may allow an austenite grain to be refined in a case in which subsequent heat treatments are undertaken, and may facilitate employment of a carbide. Thus, strength and ductility of the steel plate may be improved. Meanwhile, FIG. 1 is a view illustrating a microstructure, observed with an electron microscope, of a steel plate before heat treatment according to an exemplary embodiment in the present disclosure. It can be confirmed in FIG. 1 that ferrite and pearlite structures are elongated in a rolling direction, and a fine carbide is formed inside the pearlite structure.

Next, the cold-rolled steel plate is heated to a heating temperature (T*) of Ar3° C. to Ar3+500° C. For example, in a case in which the heating temperature (T*) is less than Ar3° C., austenite may not be sufficiently formed. Thus, a martensite structure of 90 volume % or more may not be obtained after cooling the steel plate. On the other hand, in a case in which the heating temperature (T*) exceeds Ar3° C.+500° C., an austenite grain may be coarsened, and diffusion of carbon may be accelerated. Thus, two kinds of martensite having different levels of hardness may not be obtained after cooling the steel plate. Thus, the heating temperature may be Ar3° C. to Ar3+500° C., and in detail, be Ar3° C. to Ar3+300° C.

In a case in which heating the steel plate, a heating rate ($v_r$, ° C./sec) may satisfy the following relational expression 2. If the $v_r$ does not satisfy relational expression 2, an austenite grain is coarsened during heating of the steel plate, and carbon is excessively diffused. Thus, two kinds of martensite having different hardness may not be obtained after cooling the steel plate. Meanwhile, as a heating rate is increased, an austenite grain is prevented from being coarsened and carbon is prevented from being diffused. Thus, an upper limit thereof is not particularly limited.

$$v_r \geq (T^*/110)^2 \quad \text{[Relational Expression 2]}$$

Meanwhile, according to an exemplary embodiment in the present disclosure, the cold-rolled and heated steel plate may have an austenite single phase structure having an average diameter of 20 μm or less as a microstructure thereof. In a case in which an average diameter of the austenite single phase structure exceeds 20 μm, there may be a risk of coarsening a packet size of a martensite structure formed after cooling the steel plate, and there may be a risk of decreasing strength and ductility of the steel plate by increasing a martensite transformation temperature.

Next, the heated steel plate is cooled. In this case, a cooling rate ($v_c$, ° C./sec) may satisfy the following relational expression 3. If the $v_c$ does not satisfy relational expression 3, an austenite grain is coarsened during cooling of the steel plate, and carbon is excessively diffused. Thus, two kinds of martensite having different hardness may not be obtained after cooling the steel plate. In addition, a structure of the steel plate may be transformed into a ferrite, pearlite, or bainite structure during cooling of the steel plate. Thus, it may be difficult to secure a targeted martensite volume fraction. Meanwhile, as the cooling rate is increased, an austenite grain may be prevented from being coarsened and carbon may be prevented from being diffused. Thus, an upper limit thereof is not particularly limited.

$$V_c \geq (T^*/80)^2 \quad \text{[Relational Expression 3]}$$

Meanwhile, according to an exemplary embodiment in the present disclosure, in a case in which cooling the heated steel plate, a high-temperature retention time ($t_m$, sec) may satisfy the following relational expression 4. The high-temperature retention time means the time required for initiating cooling of a steel plate having reached a heating temperature. In a case in which the high-temperature retention time satisfies relational expression 4, carbon may be prevented from being excessively diffused, and in addition, since an average diameter of an austenite grain before cooling is controlled to be 20 μm or less, martensite having an average packet size of 20 μm or less after cooling may be secured. Meanwhile, as the high-temperature retention time is further decreased, an austenite grain may be prevented from being coarsened and carbon from being diffused. Thus, a lower limit thereof is not particularly limited.

$$t_m \leq (8-0.006*T^*)^2 \quad \text{[Relational Expression 4]}$$

Hereinafter, the exemplary embodiments in the present disclosure will be described in more detail. The present disclosure may, however, be exemplified in many different forms and should not be construed as being limited to the specific embodiments set forth herein. While exemplary embodiments are shown and described, it will be apparent to those skilled in the art that modifications and variations could be made without departing from the scope of the present invention as defined by the appended claims below.

Embodiment

After steel plates having compositions illustrated in Table 1 is prepared, the steel plates were cold-rolled, heated, and cooled in a condition of Table 2. Then, a microstructure of the steel plate was observed, mechanical properties were measured, and the results therefrom are shown in Table 3. In this case, a tensile test was performed at a rate of 5 mm/min with respect to an ASTM subsized specimen, and a Vickers hardness test of each microstructure was performed at a condition in which the microstructure was maintained at a load of 5 g for 10 seconds.

TABLE 1

| | Steels | | | | |
|---|---|---|---|---|---|
| | C | Mn | Si | P | S |
| Comparative Steel 1 | 0.04 | 0.17 | 0.005 | 0.01 | 0.005 |
| Inventive Steel 1 | 0.10 | 1.49 | 0.003 | 0.02 | 0.003 |
| Inventive Steel 2 | 0.21 | 0.89 | 0.005 | 0.015 | 0.012 |

TABLE 2

| Steels | Reduction Ratio (%) | T* (° C.) | $v_r$ (° C./sec) | $v_r$* (° C./sec) | $v_c$ (° C./sec) | $v_c$* (° C./sec) | $t_m$ (sec) | $t_m$* (sec) | Note |
|---|---|---|---|---|---|---|---|---|---|
| Comparative Steel 1 | 70 | 1000 | 300 | 83 | 1000 | 156 | 1 | 4 | Comparative Example 1 |
| Comparative Steel 1 | 70 | 900 | 300 | 67 | 1000 | 126 | 1 | 6.8 | Comparative Example 2 |
| Inventive Steel 1 | 60 | 700 | 300 | 40 | 1000 | 76 | 1 | 14 | Comparative Example 3 |
| Inventive Steel 1 | 60 | 900 | 300 | 67 | 1000 | 126 | 1 | 6.8 | Inventive Example 1 |
| Inventive Steel 1 | 60 | 1000 | 300 | 82 | 1000 | 156 | 1 | 4 | Inventive Example 2 |
| Inventive Steel 2 | 70 | 900 | 300 | 67 | 1000 | 126 | 1 | 6.8 | Inventive Example 3 |
| Inventive Steel 2 | 70 | 1000 | 300 | 83 | 1000 | 156 | 1 | 4 | Inventive Example 4 |
| Inventive Steel 2 | 70 | 1100 | 300 | 100 | 1000 | 189 | 1 | 2 | Inventive Example 5 |
| Inventive Steel 2 | 70 | 1200 | 300 | 119 | 1000 | 225 | 0.1 | 0.6 | Inventive Example 6 |
| Inventive Steel 2 | 70 | 1000 | 200 | 83 | 1000 | 156 | 1 | 4 | Inventive Example 7 |
| Inventive Steel 2 | 70 | 1000 | 100 | 83 | 1000 | 156 | 1 | 4 | Inventive Example 8 |
| Inventive Steel 2 | 70 | 1000 | 300 | 83 | 200 | 156 | 1 | 4 | Inventive Example 9 |
| Inventive Steel 2 | 70 | 1000 | 300 | 83 | 1000 | 156 | 2 | 4 | Inventive Example 10 |
| Inventive Steel 2 | 70 | 1000 | 50 | 83 | 1000 | 156 | 1 | 4 | Comparative Example 4 |
| Inventive Steel 2 | 70 | 700 | 300 | 40 | 1000 | 76 | 1 | 14 | Comparative Example 5 |
| Inventive Steel 2 | 70 | 1000 | 300 | 83 | 1000 | 156 | 5 | 4 | Comparative Example 6 |
| Inventive Steel 2 | 70 | 1000 | 300 | 83 | 1000 | 156 | 20 | 4 | Comparative Example 7 |
| Inventive Steel 2 | 70 | 1000 | 300 | 83 | 80 | 156 | 1 | 4 | Comparative Example 8 |
| Inventive Steel 2 | 70 | 1200 | 300 | 119 | 1000 | 225 | 1 | 0.6 | Comparative Example 9 |
| Inventive Steel 2 | 70 | 1300 | 300 | 140 | 1000 | 264 | 1 | 0.04 | Comparative Example 10 |

$v_r$* is a heating rate ($(T^*/110)^2$) calculated by relational expression 2, $v_c$* is a cooling rate ($(T^*/80)^2$) calculated by relational expression 3, and $t_m$* is a high-temperature retention time ($(8 - 0.006 * T^*)^2$) calculated by relational expression 4.

TABLE 3

| Steels | Micro-structure | First hardness (HV) | Second hardness (HV) | relational expression 1 | Packet Size (μm) | Tensile Strength (MPa) | Elongation (%) | Note |
|---|---|---|---|---|---|---|---|---|
| Comparative Steel 1 | F + P | — | — | — | — | 655 | 11.1 | Comparative Example 1 |
| Comparative Steel 1 | F + P | — | — | — | — | 661 | 17.8 | Comparative Example 2 |
| Inventive Steel 1 | F + P | — | — | — | — | 1014 | 11.9 | Comparative Example 3 |
| Inventive Steel 1 | M1 + M2 | 454 | 372 | 28.1 | 8.9 | 1347 | 8.2 | Inventive Example 1 |
| Inventive Steel 1 | M1 + M2 | 437 | 368 | 25.8 | 12.2 | 1311 | 9.7 | Inventive Example 2 |
| Inventive Steel 2 | M1 + M2 | 662 | 513 | 22.5 | 6.8 | 1795 | 7.4 | Inventive Example 3 |
| Inventive Steel 2 | M1 + M2 | 650 | 520 | 20 | 8.5 | 1775 | 8.1 | Inventive Example 4 |
| Inventive Steel 2 | M1 + M2 | 627 | 510 | 23.7 | 13.7 | 1771 | 7.7 | Inventive Example 5 |
| Inventive Steel 2 | M1 + M2 | 619 | 526 | 25.1 | 16.7 | 1702 | 8.1 | Inventive Example 6 |
| Inventive Steel 2 | M1 + M2 | 634 | 513 | 19.1 | 11.8 | 1763 | 7.3 | Inventive Example 7 |

TABLE 3-continued

| Steels | Micro-structure | First hardness (HV) | Second hardness (HV) | relational expression 1 | Packet Size (μm) | Tensile Strength (MPa) | Elongation (%) | Note |
|---|---|---|---|---|---|---|---|---|
| Inventive Steel 2 | M1 + M2 | 607 | 549 | 9.6 | 10.7 | 1742 | 7.1 | Inventive Example 8 |
| Inventive Steel 2 | M1 + M2 | 614 | 545 | 11.2 | 9.1 | 1711 | 7.2 | Inventive Example 9 |
| Inventive Steel 2 | M1 + M2 | 631 | 560 | 11.2 | 9.6 | 1759 | 7.2 | Inventive Example 10 |
| Inventive Steel 2 | M1 + M2 | 567 | 540 | 4.7 | 15.5 | 1687 | 6.4 | Comparative Example 4 |
| Inventive Steel 2 | F + P | — | — | — | — | 1387 | 3.2 | Comparative Example 5 |
| Inventive Steel 2 | M1 + M2 | 591 | 563 | 4.8 | 19.7 | 1712 | 5.9 | Comparative Example 6 |
| Inventive Steel 2 | M1 + M2 | 578 | 553 | 4.3 | 27.7 | 1699 | 2.9 | Comparative Example 7 |
| Inventive Steel 2 | F + P | — | — | — | — | 649 | 20.1 | Comparative Example 8 |
| Inventive Steel 2 | M1 + M2 | 570 | 543 | 22.1 | 4.7 | 1689 | 6.7 | Comparative Example 9 |
| Inventive Steel 2 | M1 + M2 | 559 | 536 | 28.9 | 4.1 | 1684 | 6.4 | Comparative Example 10 |

Here, F is ferrite, P is pearlite, M1 is martensite having a first hardness, and M2 is martensite having a second hardness Inventive examples 1 to 10, satisfying a composition and a manufacturing method according to an exemplary embodiment in the present disclosure, include two kinds of martensite, a hardness difference of which is between 5% to 30%, thereby having tensile strength of 1200 MPa or more and elongation of 7% or more.

Meanwhile, comparative examples 1 and 2 include ferrite and pearlite as a microstructure after heat treatment as a carbon content in steel is relatively low, and strength thereof is inferior.

In addition, in comparative example 3, since a heating temperature (T*) is relatively low, ferrite and pearlite are included as a microstructure after heat treatment, and strength thereof is inferior. In comparative example 5, a heating temperature (T*) is relatively low, but a carbon content is relatively high. Thus, strength of steel is in a range controlled according to an exemplary embodiment in the present disclosure. However, a rolling structure by cold rolling is not sufficiently loosened, whereby ductility thereof is inferior.

In addition, in comparative examples 4, 6, 7, 9, and 10, one of $v_r$ and $t_m$ is outside of a range controlled according to an exemplary embodiment in the present disclosure. Thus, an austenite grain is coarsened, and carbon is diffused, whereby a martensite structure in which a difference of hardness is less than 5% is formed. In addition, steel strength is excellent, but ductility thereof is inferior.

In addition, in comparative example 8, $v_c$ is outside of a range controlled according to an exemplary embodiment in the present disclosure. Ferrite and pearlite structures are formed during cooling the steel plate, and ductility thereof is excellent but strength is inferior.

Meanwhile, FIG. 2 is a view illustrating a microstructure of a steel plate after heat treatment, observed with an optical microscope, according to inventive example 4 of the present disclosure. FIG. 3 is a view illustrating a microstructure of a steel plate after heat treatment, observed with an optical microscope, according to comparative example 5. Referring to FIG. 2, in a case of inventive example 4, a size of a martensite packet is finely formed to be 20 μm or less. Thus, a plate inside the packet is also finely formed. Meanwhile, referring to FIG. 3 illustrating comparative example 5, a size of a martensite packet exceeds 20 μm, and thus, martensite is formed to be coarse. In addition, a plate inside the packet is also formed to be coarse.

The invention claimed is:

1. A quenched steel sheet comprising, by wt %, carbon (C): 0.05% to 0.25%, silicon (Si): 0.5% or less (with the exception of 0), manganese (Mn): 0.1% to 2.0%, phosphorus (P): 0.05% or less, sulfur (S): 0.03% or less, iron (Fe) as a residual component thereof, and other unavoidable impurities, wherein the quenched steel sheet includes 90 volume % or more of martensite having a first hardness and martensite having a second hardness as a microstructure of the steel, wherein the martensite having the first hardness and the martensite having the second hardness as a microstructure are formed in an entire area of the steel sheet, wherein the first hardness has a greater hardness value than a hardness value of the second hardness, and a ratio of a difference between the first hardness and the second hardness to the first hardness satisfies relational expression 1, $$5 \leq (\text{first hardness-second hardness})/(\text{first hardness}) * 100 \leq 30, \text{ and} \quad \text{[Relational Expression 1]}$$

wherein average packet sizes of the martensite having the first hardness and the martensite having the second hardness are 20 μm or less.

2. The quenched steel sheet of claim 1, wherein a tensile strength of the steel sheet is 1200 MPa or more, and elongation of the steel sheet is 7% or more.

3. A quenched steel sheet provided by cold rolling and heat treating a steel sheet comprising, by wt %, carbon (C): 0.05% to 0.25%, silicon (Si): 0.5% or less (with the exception of 0), manganese (Mn): 0.1% to 2.0%, phosphorus (P): 0.05% or less, sulfur (S): 0.03% or less, iron (Fe) as a residual component thereof, and other unavoidable impurities, and comprising ferrite and pearlite as a microstructure, wherein the microstructure of the quenched steel sheet includes 90 volume % or more of martensite having a first hardness and martensite having a second hardness, the martensite having the first hardness is provided through transformation occurring from pearlite before heat treatment and in a region adjacent to the pearlite before heat treatment, and the martensite having the second hardness is provided through transformation occurring from ferrite before heat treatment and in a region adjacent to the ferrite before heat treatment, wherein the martensite having the first hardness and the martensite having the second hardness as a microstructure are formed in an entire area of the steel sheet, wherein the first hardness has a greater hardness value than a hardness value of the second hardness, and a ratio of a difference between the first hardness and the second hardness to the first hardness satisfies relational expression 1, $$5 \leq (\text{first hardness-second hardness})/(\text{first hardness}) * 100 \leq 30, \text{ and} \quad \text{[Relational Expression 1]}$$

wherein average packet sizes of the martensite having the first hardness and the martensite having the second hardness are 20 μm or less.

4. The quenched steel sheet of claim 3, wherein a tensile strength of the steel sheet is 1200 MPa or more, and elongation of the steel sheet is 7% or more.

* * * * *